US009327863B1

(12) United States Patent
Baselice

(10) Patent No.: US 9,327,863 B1
(45) Date of Patent: May 3, 2016

(54) INTEGRATED GIFT BOX AND ORNAMENTAL CHARACTER ARTICLE AND METHOD AND SYSTEM FOR CONSTRUCTING INTEGRATED ARTICLE

(71) Applicant: Anthony E. Baselice, Davie, FL (US)

(72) Inventor: Anthony E. Baselice, Davie, FL (US)

( * ) Notice: Subject to any disclaimer, the term of this patent is extended or adjusted under 35 U.S.C. 154(b) by 0 days.

(21) Appl. No.: 14/146,977

(22) Filed: Jan. 3, 2014

(51) Int. Cl.
*B65D 5/62* (2006.01)
*B65D 5/42* (2006.01)

(52) U.S. Cl.
CPC . *B65D 5/425* (2013.01); *B65D 5/62* (2013.01)

(58) Field of Classification Search
CPC ..... A63H 3/005; B65D 81/365; B65D 81/368
USPC ..... 206/457, 458, 459.5; 229/103, 116.3, 229/922; 446/72–80; D3/271.1, 271.3
See application file for complete search history.

(56) References Cited

U.S. PATENT DOCUMENTS 1,330,780 A * 2/1920 Bonte ..... 229/116.3
4,411,097 A * 10/1983 Murakami ..... 446/73
4,666,042 A * 5/1987 Dlott et al. ..... 206/457
6,712,211 B1 * 3/2004 Chan ..... 206/457
2002/0195480 A1 * 12/2002 Daniels ..... 446/73
2006/0219764 A1 * 10/2006 Copeman ..... 206/457
2010/0065457 A1 * 3/2010 Halstrom et al. ..... 206/459.1

FOREIGN PATENT DOCUMENTS

GB 262631 A * 12/1926

* cited by examiner

*Primary Examiner* — Bryon Gehman
(74) *Attorney, Agent, or Firm* — H. John Rizvi; Gold & Rizvi, P.A

(57) ABSTRACT

A system for constructing an integrated gift box and ornamental character article includes a plurality of sides and a lid forming a box having an interior compartment adapted to enclose a gift therein. The lid is movable relative to the sides to open and close the interior compartment for placing the gift into and removing the gift from the interior compartment such that the box has an internal construction that functions as a gift box. The system also includes a plurality of appendages attached and extending outwardly from at least some exterior surfaces of different ones of the sides of the box, and a plurality of graphical images applied on at least some exterior surfaces of different ones of box sides such that the box, appendages and graphical images integrate together to provide an external construction that functions as an ornamental character wherein the box also functions as a body of the ornamental character.

20 Claims, 5 Drawing Sheets

INTEGRATED GIFT BOX AND ORNAMENTAL CHARACTER ARTICLE AND METHOD AND SYSTEM FOR CONSTRUCTING INTEGRATED ARTICLE

FIELD OF THE INVENTION

The present invention relates to gift wrapping, and more particularly, is concerned with an integrated gift box and ornamental character article and method and system for constructing the integrated article.

BACKGROUND OF THE INVENTION

The use of cardboard gift boxes is well known in the art. Gift boxes have been used for the presentation of gifts for all kinds of occasions imaginable, such as birthdays, holidays, anniversaries, and the like. Many different kinds of gift boxes have been developed for gift presentations, ranging from simple to complex gift box configurations.

Known types of boxes include those having four sidewalls each including flaps at either ends. The flaps are folded over and secured to create a top and bottom. Some other types of boxes include tops that are removable. These boxes are designed such that the sidewalls are fixed relative to one another.

There are many different gift box approaches in the prior art. For example, a box with sides that are typically formed from a single piece of support material that may be scored where the sides and bottom meet. The thickness of the scored area is thinner than that of the sides and bottom. This operates to allow the sides to be rotated upward to form around the item or gift stored within the box and a lid applied over the tops of the sides. Removal of the lid allows the sides to drop away from the stored item that rests on the bottom of the box.

Another known example is a gift box that includes a detachable gift support for insertion into a gift box after construction from a one-piece sheet of material. Gift restraints are provided for restraining the gift on the gift support. Frequently, the gift is in the shape of a card, such as a credit card, and is commonly what is known as a gift card, similar to a gift certificate.

Various types of combination greeting card and gift boxes are also known. One problem with known combination greeting card/gift boxes is that the message or greeting on the front of the product is exposed which reduces the enjoyment associated with the surprise and anticipation in receiving a gift and reading the greeting card message.

Additionally, the gift may be pre-packaged in the box with the greeting card which does not allow selection of a gift separate from the greeting card. Purchasing the card and gift together as a single product does not allow for individual tailoring of the greeting/gift combination to meet the unique needs of individuals and various situations.

Accordingly, even though the above cited gift boxes of the prior art address some of the needs of the market, there remains a need in the art for a more personalized gift wrapping approach.

SUMMARY OF THE INVENTION

The present invention overcomes the deficiencies of the known art and the problems that remain unsolved by providing an integrated gift box and ornamental character article and method and system for constructing the integrated article.

The integrated article allows the wrapping of a gift and at the same time provides additional fun and aesthetical features to the gift.

In one aspect of the present invention, an integrated gift box and ornamental character article includes:

- a box having
  - a plurality of sides defining an interior compartment adapted to enclose a gift therein, and
  - at least one of the sides being movable relative to the other of the sides of the box to open and close the interior compartment for placing the gift into and removing the gift from the internal compartment such that the box has an internal construction that functions as a gift box;
- a multiplicity of appendages attached to and extending outwardly from an exterior surface of the box, the appendages including
  - a first plurality of the appendages attached to and extending from different lateral ones of the sides of the box, and
  - a second plurality of the appendages attached to and extending below a bottom one of the sides of the box; and
- at least one graphical image applied on the exterior surface at least on a portion of one of the sides of the box above the first plurality of appendages such that the box, the multiplicity of appendages and the graphical image integrate together to provide an external construction that serves as an ornamental character wherein the box also functions as a body of the ornamental character.

In another aspect of the present invention, a method for constructing an integrated gift box and ornamental character article includes:

- assembling a box so as to have a plurality of sides defining an interior compartment adapted to enclose a gift therein;
- making at least one of the sides movable relative to the other of the sides of the box to open and close the interior compartment for placing the gift into and removing the gift from the interior compartment such that the box has an internal construction that functions as a gift box;
- attaching a multiplicity of appendages to the box so that the appendages extend outwardly from an exterior surface of the box, wherein
  - a first plurality of the appendages attaches to and extends from different lateral ones of the sides of the box, and
  - a second plurality of the appendages attaches to and extends below a bottom one of the sides of the box; and
- applying at least one graphical image on the exterior surface at least on a portion of one of the sides of the box above the first plurality of appendages such that the box, the multiplicity of appendages and the graphical image integrate together to provide an external construction that functions as an ornamental character wherein the box also functions as a body of the ornamental character.

In still another aspect of the present invention, a system for constructing an integrated gift box and ornamental character article includes:

- a plurality of sides and a lid forming a main box having an interior compartment adapted to enclose a gift therein, the lid being movable relative to the plurality of sides to open and close the interior compartment for placing the gift into and removing the gift from the interior compartment such that the main box has an internal construction that functions as a gift box;

a plurality of appendages attached and extending outwardly from at least some exterior surfaces of different ones of the sides of the main box; and a plurality of graphical images applied on at least some of exterior surfaces of different ones of the sides of the main box such that the main box, appendages and graphical images integrate together to provide an external construction that functions as an ornamental character wherein the main box also functions as a body of the ornamental character.

These and other aspects, features, and advantages of the present invention will become more readily apparent from the attached drawings and the detailed description of the preferred embodiments, which follow.

BRIEF DESCRIPTION OF THE DRAWINGS

The preferred embodiments of the invention will hereinafter be described in conjunction with the appended drawings provided to illustrate and not to limit the invention, in which.

Like reference numerals refer to like parts throughout the several views of the drawings.

DETAILED DESCRIPTION

Figure 1:
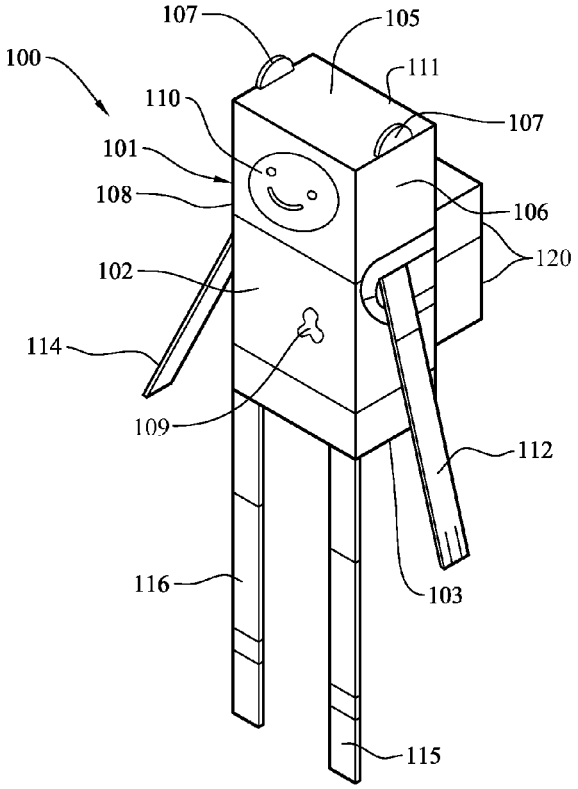
FIG. 1 presents an isometric view of a first exemplary embodiment of an integrated gift box and ornamental character article in accordance with an aspect of the present invention.
Figure 2:
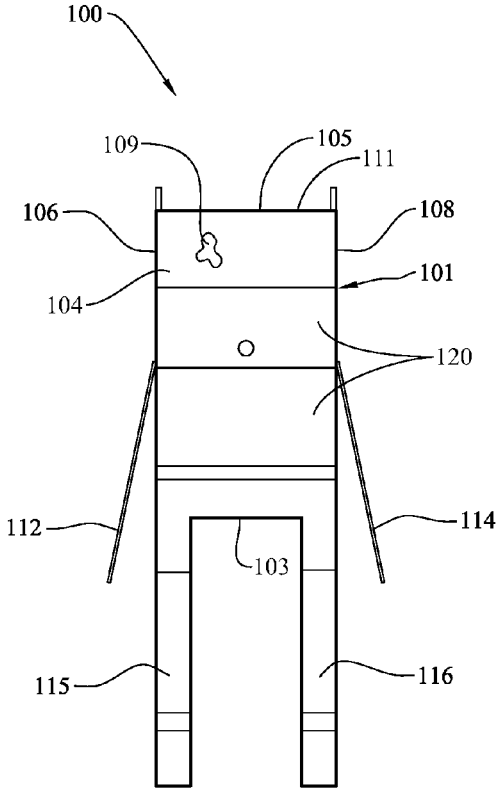
FIG. 2 presents a rear elevation view of the integrated article of FIG. 1.
Figure 3:
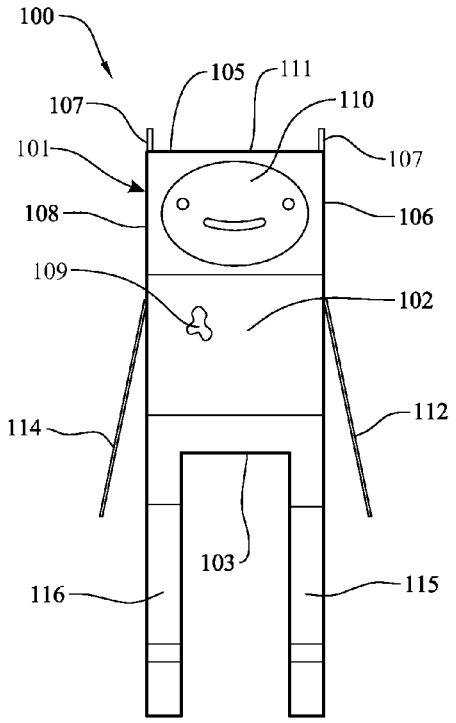
FIG. 3 presents a front elevation view of the integrated article of FIG. 1.
Figure 4:
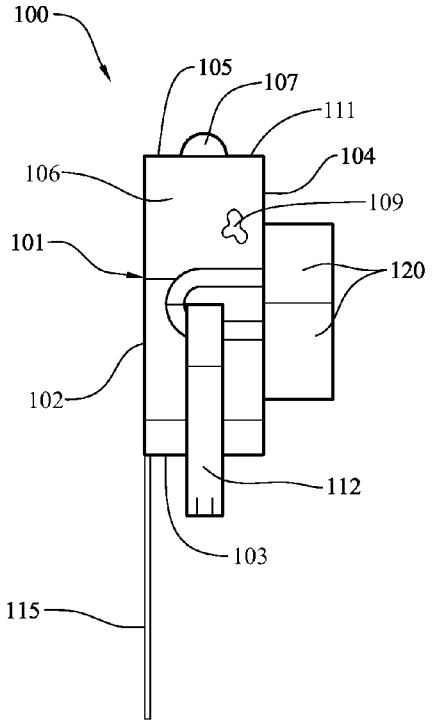
FIG. 4 presents a side elevation view of the integrated article of FIG. 1.
Figure 5:
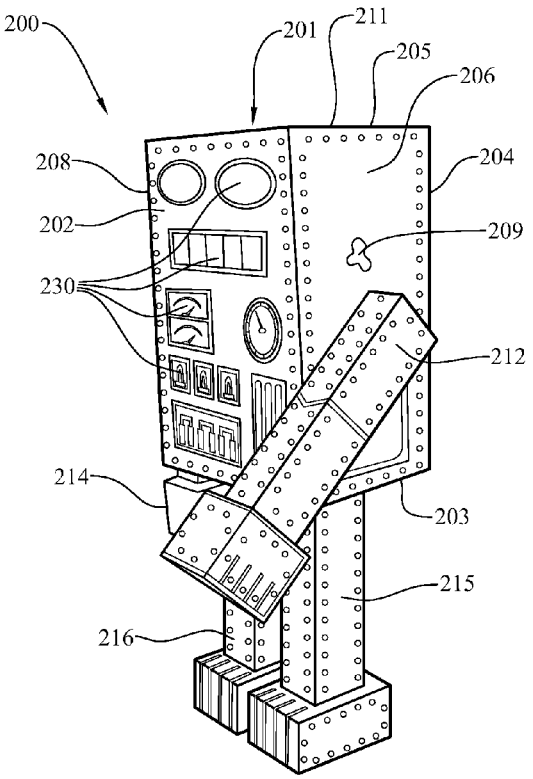
FIG. 5 presents an isometric view of a second exemplary embodiment of an integrated gift box and ornamental character article in accordance with an aspect of the present invention.
Figure 6:
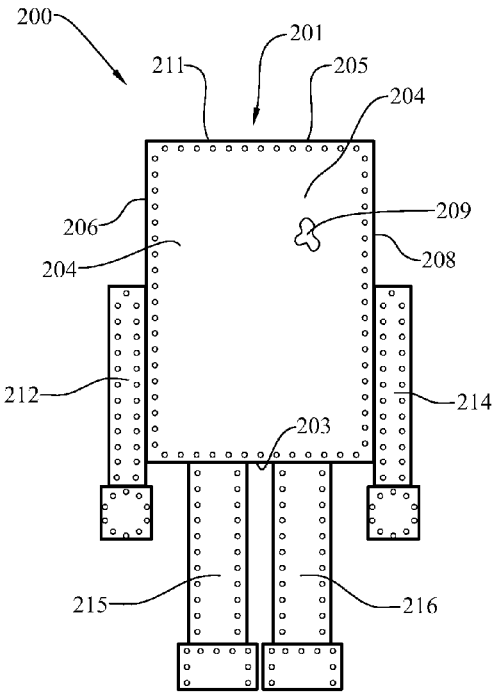
FIG. 6 presents a rear elevation view of the integrated article of FIG. 5.
Figure 7:
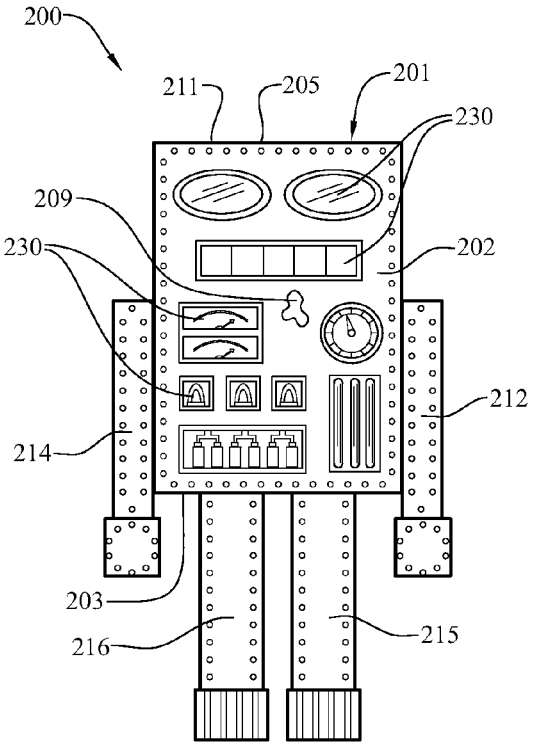
FIG. 7 presents a front elevation view of the integrated article of FIG. 5.
Figure 8:
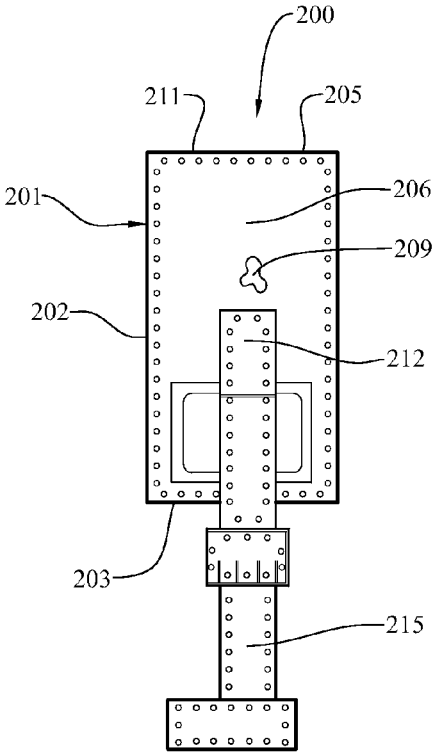
FIG. 8 presents a side elevation view of the integrated article of FIG. 5.

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper", "lower", "left", "rear", "right", "front", "vertical", "horizontal", and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Referring now to FIGS. 1-4, there is illustrated a first exemplary embodiment of an integrated gift box and ornamental character article, generally designated 100, in accordance with an aspect of the present invention. The integrated article 100 includes a box 101 having an interior compartment 109 adapted to enclose a gift therein. The box 101 has a plurality of sides, including a front side 102, a bottom side 103, a rear side 104, a top side 105, a first lateral side 106, and a second lateral side 108. At least one of the sides, such as the top side 105, is movable relative to the other sides to open and close the interior compartment 109 of the box 101 which has amble space or volume for placing the gift into and removing the gift from the interior compartment 109.

More particularly, the movable top side 105 may be a lid 111 removable from and replaceable onto the box 101 such that the box has an internal construction that functions as a gift box. The lid 111 formed by the top side 105 may have one or more ears 107 thereon simulating ears of a character that may be pulled on to move the lid 111 to open the box 101. Thus, the box 101 may be six-sided and rectangular in shape; alternatively the box may have another number of sides and be of other shapes. Considering the box 101 of the integrated article 100 to be a main box, the integrated article 100 at the rear side 104 thereof may include an additional, or supplemental, box 120, being attached to the main box 101, which is intended to resemble or simulate, for example, a gift card box or a backpack of the character.

The integrated article 100 also includes a plurality of appendages 112, 114, 115, 116 attached and extending outwardly from at least some exterior surfaces of different ones of the sides, for example, bottom side 103 and first and second lateral sides 106, 108, of the box 101. A first plurality of the appendages, namely appendages 112, 114, are attached to and extend from the first and second lateral sides 106, 108 of the box 101, and a second plurality of the appendages, namely appendages 115, 116, are attached to and extend below the bottom side 103 of the box 101. The box 101 and appendages 112, 114, 115, 116 may be made of cardboard material or, alternatively, another suitable material, such as plastic. More particularly, the appendages 112, 114, 115, 116 may simulate, for example, one or more of arms, legs or claws of a human being, animal, cartoon character, and the like. The appendages 112, 114 attached on the first and second lateral sides 106, 108 may be elongated flat pieces or strips of cardboard that are intended to resemble or simulate the arms of a particular character, whereas the appendages 115, 116 attached on the bottom side 103 may be elongated flat pieces or strips of cardboard that resemble or simulate the legs of the particular character.

The integrated article 100 further includes at least one graphical image 110 applied on an exterior surface at least on a portion of a side of the box 101, such as the front side 102, above the appendages 112, 114. In such manner, the box 101, appendages 112, 114, 115, 116 and the graphical image 110 integrate together to provide an external construction that functions as an ornamental character wherein the main box 101 also functions as a body of the ornamental character. The graphical image 110 may be printed or otherwise applied thereon and resemble or simulate a face, wherein the face can be representative of a human being, an animal, a cartoon character, and the like.

Referring now to FIGS. 5-8, there is illustrated a second exemplary embodiment of an integrated gift box and ornamental character article, generally designated 200, in accordance with an aspect of the present invention. The integrated article 200 includes a box 201 having an interior compartment 209 adapted to enclose a gift therein. The box 201 has a plurality of sides, including a front side 202, a bottom side 203, a rear side 204, a top side 205, a first lateral side 206, and a second lateral side 208. At least one of the sides, such as the top side 205, is movable relative to the other sides to open and close the interior compartment 209 of the box 201 which has amble space or volume for placing the gift into and removing the gift from the interior compartment 209. More particularly, the movable top side 205 may be a lid 211 removable from and replaceable onto the box 201 such that the box has an internal construction that functions as a gift box. Thus, the box 201 may be six-sided and rectangular in shape; alternatively the box may have another number of sides and be of other shapes.

The integrated article 200 also includes a plurality of appendages 212, 214, 215, 216 attached and extending outwardly from at least some exterior surfaces of different ones of the sides, for example, bottom side 203 and first and second lateral sides 206, 208, of the box 201. A first plurality of the appendages, namely appendages 212, 214, are attached to and extend from the first and second lateral sides 206, 208 of the box 201, and a second plurality of the appendages, namely appendages 215, 216, are attached to and extend below the bottom side 203 of the box 201. The box 201 and appendages 212, 214, 215, 216 may be made of cardboard material or, alternatively, another suitable material, such as plastic. More particularly, the appendages 212, 214, 215, 216 may simulate, for example, arms and legs of a robot and the like. The appendages 212, 214 attached on the first and second lateral sides 206, 208 may be elongated tubular pieces of cardboard that are intended to resemble or simulate the arms of the robot, whereas the appendages 215, 216 attached on the bottom side 203 may be elongated tubular pieces of cardboard that resemble or simulate the legs of the robot.

The integrated article 200 further includes a plurality of graphical images 230 applied on an exterior surface at least one of the sides of the box 201, such as the front side 202, both above and between the appendages 212, 214. In such manner, the box 201, appendages 212, 214, 215, 216 and the graphical image 230 integrate together to provide an external construction that functions as an ornamental character, such as the robot, wherein the box 201 also functions as a body of the ornamental character. The graphical images 230 may be printed or otherwise applied thereon and resemble or simulate a face of the robot and a plurality of buttons, meters or lights of the robot.

Figure 9:
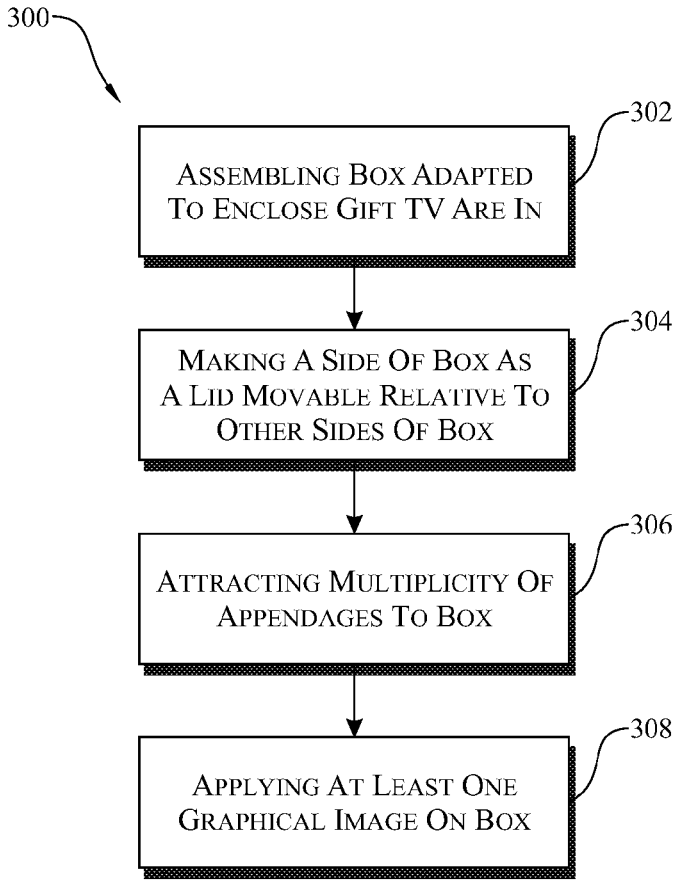
FIG. 9 presents a flow chart illustrating an exemplary embodiment of a method for constructing the integrated article of either the first and second exemplary embodiments in accordance with an aspect of the present invention.

Referring now to FIG. 9, there is illustrated a flow chart 300 directed to a method for constructing either of the exemplary embodiments of the integrated article 100, 200, in accordance with an aspect of the present invention. The flow chart 300 of the method includes: a first block 302 denoting assembling the box so as to have the plurality of sides defining the interior compartment adapted to enclose the gift therein; a second block 304 denoting making at least one of the sides as a lid movable relative to the other of the sides of the box to open and close the interior compartment for placing the gift into and removing the gift from the interior compartment such that the box has an internal construction that functions as a gift box; a third block 306 denoting attaching the multiplicity of appendages to the box so that the appendages extend outwardly from an exterior surface of the box, wherein a first plurality of the appendages attaches to and extends from different lateral ones of the sides of the box, and a second plurality of the appendages attaches to and extends below a bottom one of the sides of the box; and a fourth block 308 denoting applying at least one graphical image on the exterior surface at least on a portion of one of the sides of the box above the first plurality of appendages such that the box, the multiplicity of appendages and the graphical image integrate together to provide an external construction that functions as an ornamental character wherein the box also functions as a body of the ornamental character.

Further, with respect to both exemplary embodiments shown in FIGS. 1-4 and 5-8, the present invention is directed to a system for constructing either of the integrated articles 100, 200 in accordance with an aspect of the present invention. The system includes the plurality of sides 102-106, 108 and 202-206, 208 and the lid 111 and 211 forming the box 101 and 201 having the interior compartment 109 and 209 adapted to enclose a gift therein. The lid 111 and 211 is movable relative to the sides to open and close the interior compartment for placing the gift into and removing the gift from the interior compartment such that the box has an internal construction that functions as a gift box. The system also includes a plurality of appendages 112, 114, 115, 116 and 212, 214, 215, 216 attached and extending outwardly from exterior surfaces of different ones of the sides of the box, and a plurality of graphical images 110 and 230 applied on at least some exterior surfaces of different ones of box sides such that the box, appendages and graphical images integrate together to provide an external construction that functions as an ornamental character wherein the box also functions as a body of the ornamental character.

In summary, the integrated article 100, 200 of the present invention provides a combined gift box and ornamental character which allows the wrapping of a gift and at the same time provides additional fun and aesthetical features to the gift. Moreover, the integrated article, among other things, provides for a more personalized, particularized and aesthetically pleasing as well as enhanced display and construction of a gift box for a gift, such as a gift card. Also, even though the two exemplary embodiments of the integrated article 100, 200 illustrate a character and a robot, this should not be interpreted as a limitation of the present invention as any other shape or type of object or body may also be employed in their place.

The above-described embodiments are merely exemplary illustrations of implementations set forth for a clear understanding of the principles of the invention. Many variations, combinations, modifications or equivalents may be substituted for elements thereof without departing from the scope of the invention. Therefore, it is intended that the invention not be limited to the particular embodiments disclosed as the best mode contemplated for carrying out this invention, but that the invention will include all the embodiments falling within the scope of the appended claims.

What is claimed is:

1. An integrated gift box and ornamental character article, comprising:

a box having a plurality of sides defining an interior compartment adapted to enclose a gift therein, said plurality of sides comprising a front side; and at least one of said sides being movable relative to the remainder of said sides of said box to open and close said interior compartment for placing the gift into and removing the gift from said interior compartment such that said box has an internal construction that functions as a gift box;

a multiplicity of appendages attached to and extending outwardly from an exterior surface of said box, said appendages including a first plurality of said appendages attached to and extending from different lateral ones of said sides of said box, and a second plurality of said appendages attached to and extending from a front edge of a bottom one of said sides of said box adjacent to said front side, said appendages of said second plurality of appendages being elongated flat pieces of cardboard arranged substantially coplanar to one another; and, at least one graphical image applied on said exterior surface at least on a portion of said front side of said box above said first plurality of appendages such that said box, said multiplicity of appendages and said at least one graphical image integrate together to provide an external construction that functions as an ornamental character wherein said box also functions as a body of said ornamental character.

2. The integrated article of claim 1 wherein said one of said sides is a lid removable from and replaceable onto said box.

3. The integrated article of claim 2 wherein said lid is a top one of said sides of said box and has one or more protruding portions thereon simulating one or more corresponding ears of a character, wherein said one or more protruding portions may be pulled on to move said lid to open said box.

4. The integrated article of claim 1 wherein said box and said first plurality of appendages are made of cardboard material.

5. The integrated article of claim 1 wherein said ornamental character simulates one of a human being, an animal, a cartoon character, and a robot.

6. The integrated article of claim 5 wherein said appendages simulate one or more of arms, legs and claws of said one of the human being, animal, cartoon character, and robot.

7. The integrated article of claim 6 wherein said at least one graphical image simulates a face of one of said human being, animal, cartoon character, and robot.

8. The integrated article of claim 1 wherein said at least one graphical image simulates one or more of a plurality of buttons, meters and lights of a robot.

9. A method for constructing an integrated gift box and ornamental character article, comprising:

assembling a box so as to have a plurality of sides defining an interior compartment adapted to enclose a gift therein, said plurality of sides comprising a front side;

making at least one of the sides movable relative to the remainder of the sides of the box to open and close the interior compartment for placing the gift into and removing the gift from the interior compartment such that the box has an internal construction that functions as a gift box;

attaching a multiplicity of appendages to the box so that the appendages extend outwardly from an exterior surface of the box, wherein a first plurality of the appendages attaches to and extends from different lateral ones of the sides of the box, and a second plurality of the appendages attaches to and extends from a front edge of a bottom one of the sides of the box adjacent to said front side, said appendages of said second plurality of appendages being elongated flat pieces of cardboard arranged substantially coplanar to one another; and applying at least one graphical image on the exterior surface at least on a portion of said front side of the box above the first plurality of appendages such that the box, the multiplicity of appendages and the at least one graphical image integrate together to provide an external construction that functions as an ornamental character wherein the box also functions as a body of the ornamental character.

10. The method of claim 9 wherein the at least one movable side is a lid removable from and replaceable onto the box.

11. The method of claim 10 wherein the lid is made with one or more protruding portions thereon to simulate one or more corresponding ears of a character, wherein said one or more protruding portions may be pulled on to move the lid to open the box.

12. The method of claim 9 further comprising making the appendages to simulate one or more of arms, legs and claws of one of a human being, animal, cartoon character, and robot.

13. The method of claim 9 wherein said at least one graphical image simulates a face of one of a human being, animal, cartoon character, and robot.

14. The method of claim 9 wherein said at least one graphical image simulates one or more of a plurality of buttons, meters and lights of a robot.

15. A system for constructing an integrated gift box and ornamental character article, comprising:

a plurality of sides and a lid forming a main box having an interior compartment adapted to enclose a gift therein, said plurality of sides comprising a front side and a bottom side, said lid being movable relative to said plurality of sides to open and close said interior compartment for placing the gift into and removing the gift from said interior compartment such that said main box has an internal construction that functions as a gift box;

a plurality of appendages attached and extending outwardly from a front edge of said bottom side adjacent to said front side of said main box, said appendages of said plurality of appendages being elongated flat pieces of cardboard arranged substantially coplanar to one another; and a plurality of graphical images applied on at least said front side of said main box such that said main box, appendages and graphical images integrate together to provide an external construction that functions as an ornamental character wherein said box also functions as a body of said ornamental character.

16. The system of claim 15 wherein said appendages simulate arms, legs or claws of a human being, animal, cartoon character, or robot.

17. The system of claim 15 wherein said sides and lid are made of cardboard material.

18. The system of claim 15 further comprising a supplemental box mounted to a rear one of said sides forming said main box wherein said supplemental box simulates one of a backpack or a gift card box.

19. The system of claim 15 wherein said plurality of graphical images simulates one or more of a plurality of buttons, meters and lights of a robot.

20. The system of claim 15 wherein said plurality of graphical images simulates a face of one of a human being, animal, cartoon character, and robot.

* * * * *